United States Patent [19]

Johansson et al.

[11] 4,055,952

[45] Nov. 1, 1977

[54] HEATING DEVICE FOR AN EXTERNAL COMBUSTION ENGINE

[75] Inventors: Lennart Nils Johansson, Eskilstuna; Claes-Goran O. Svensson, Borensberg, both of Sweden

[73] Assignee: Forenade Fabriksverken, Eskilstuna, Sweden

[21] Appl. No.: 631,121

[22] Filed: Nov. 11, 1975

[51] Int. Cl.[2] ..... F02G 1/04

[52] U.S. Cl. ..... 60/517

[58] Field of Search ..... 122/248, 250; 60/517–526

[56] References Cited

U.S. PATENT DOCUMENTS

| | | | |
|---|---|---|---|
| 2,183,893 | 12/1939 | Price | 122/250 R |
| 3,529,579 | 9/1970 | Wanson | 122/248 |
| 3,812,677 | 5/1972 | Greis | 60/517 |
| 3,822,552 | 7/1974 | Palmgren | 60/517 |
| 3,942,324 | 3/1976 | Johansson | 60/517 |

*Primary Examiner*—Allen M. Ostrager
*Attorney, Agent, or Firm*—Laurence R. Brown

[57] ABSTRACT

An external combustion engine has an insulated cylinder with one open end and heater tubes mounted at the closed end to permit entry of a heater unit concentrically within the open end to abut the heater tubes.

2 Claims, 2 Drawing Figures

HEATING DEVICE FOR AN EXTERNAL COMBUSTION ENGINE

This invention relates to a heating device for an external combustion engine comprising a cylindrical heater head of arcuately shaped pipes.

External combustion engines of this type may be hot gas engines or steam engines. In any case the combustion is normally performed by burning pre-heated air with a fossile fuel. The heating device necessary comprises a number of elements which should be ready for inspection, cleaning and service and therefore it is desirable to design it to be independent of the rest of the engine to a large extent.

According to the present invention the heating device is characterized in that a unit comprising a cylindrical combustion chamber surrounded by a recuperative heat exchanger is mounted abutting one end of said cylindrical heater head.

Figure 1:
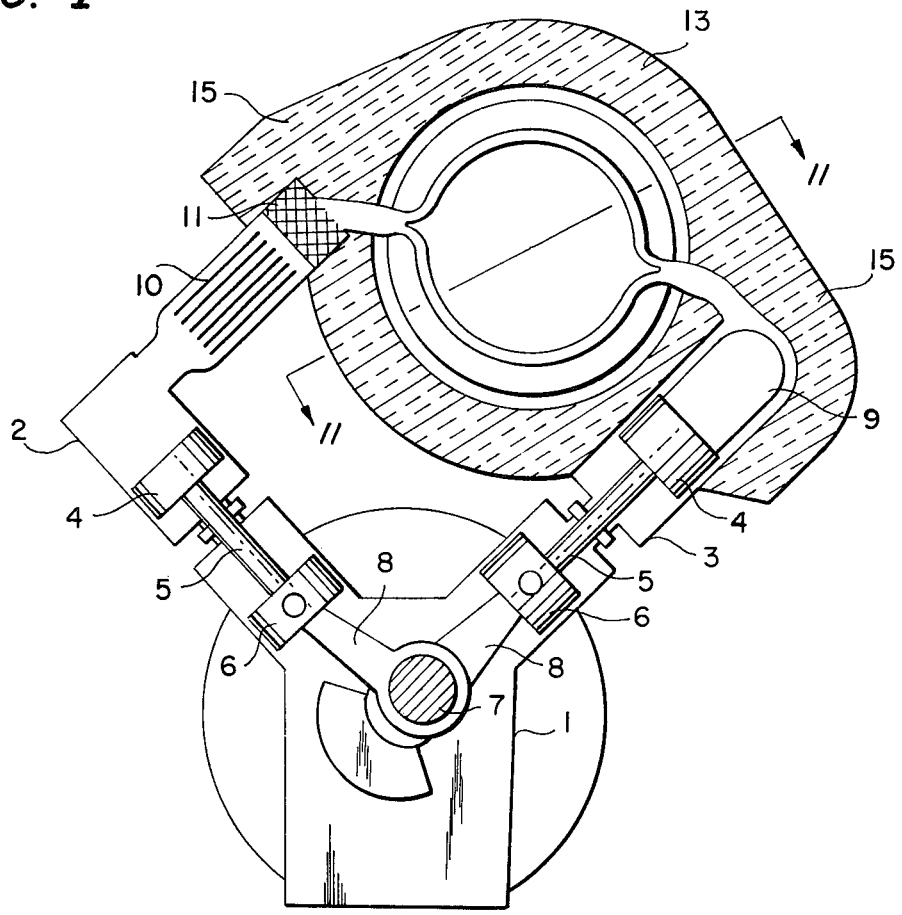
Figure 2:
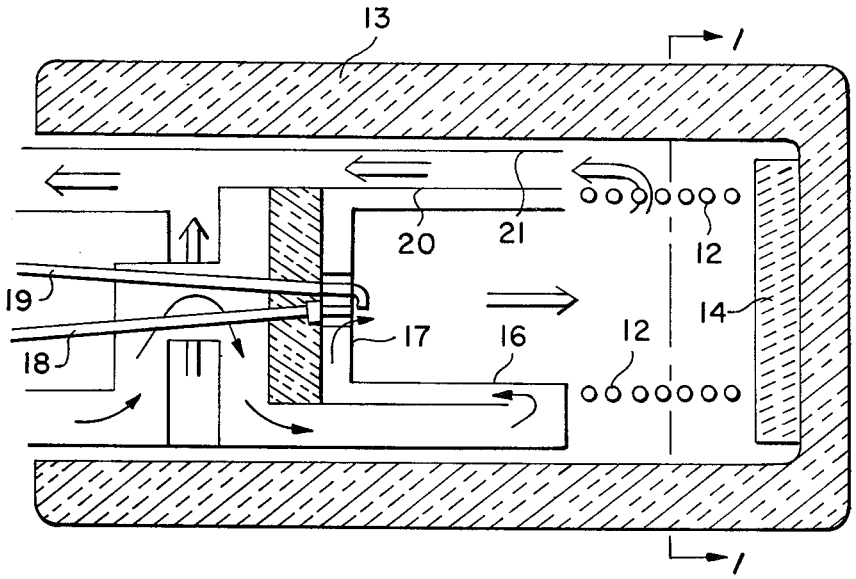

The invention will be described in more detail reference being made to the drawing in which FIG. 1 schematically and in section along the line I—I of FIG. 2 shows a hot gas engine provided with a heating device according to the invention, and FIG. 2 schematically shows the heating device of FIG. 1 in section along the line II—II of FIG. 1.

Referring first to FIG. 1 the hot gas engine shown comprises a crank casing 1 carrying a low temperature cylinder 2 and a high temperature cylinder 3. In each of said cylinders 2, 3 a piston 4 carrying a piston rod 5 and a cross head 6 is slidably mounted and connected to a crank shaft 7 by a connecting rod 8. The piston 4 located in the high temperature cylinder 3 is provided with a dome 9. The phase angle between the movements of the pistons 4 is 90°.

A charge of working gas such as hydrogen or helium is limited by the upper sides of the pistons 4, the upper ends of the cylinders 2, 3, a cooler 10, a regenerator 11 and a number of arcuately shaped heater tubes 12 connecting the upper end of the regenerator 11 to the upper end of the high temperature cylinder 3.

The device so far described and shown in FIG. 1 will operate as a hot gas engine, i.e. heat is continuously supplied to the heater tubes and continuously withdrawn from the cooler 10. The working gas charge is compressed at a low temperature in the cylinder 2, heated in the regenerator 11 and in the tubes 12 and allowed to expand at a high temperature in the cylinder 3.

FIG. 2 shows an insulated cylinder 13 which is open at one end and carrying a disc 14 of ceramic material at its bottom. The cylinder 13 is provided with projections 15 covering the regenerator 11 and the top of the cylinder 3. The insulated cylinder 13, the regenerator 11 and the top of the cylinder 3 as well as the tubes 12 may form a unit which is detachably connected to the rest of the engine. As shown in FIG. 2 the tubes 12 are arranged concentrically with the cylinder 13 and as close to the disc 14 as possible.

The heating device consists of an inner cylindrical wall 16 and a bottom 17 forming a combustion chamber. Fuel is supplied through a pipe 18 and ignited by a spark plug supplied with high voltage electricity through a cable 19.

The combustion chamber is surrounded by a concentrically arranged cylindrical intermediate wall 20 and outer cylindrical wall 21. The space between the intermediate wall 20 and the outer wall 21 is divided into a large number of axially extending passages by means of radially extending partition walls, not shown in the drawing. Each other of said axially extending passages is adapted to govern a flow of combustion air as shown by single arrows in the lower part of FIG. 2. The air flow is preheated when passing between the cylindrical walls 20, 21 and when passing along the wall 16. The hot combustion gases are shown as double arrows and will give off heat to the heater tubes 12. Subsequently the combustion gases will pass through the remaining axially extending passages in counter flow to the combustion air while giving off a substantial part of the remaining heat.

It will be understood that the walls 16, 20 and 21, the bottom 17 and the ducts for supply of combustion air and for withdrawal of combustion gases together with the fuel and electricity supply will form a constructional unit abutting the left hand end of the row of heater tubes 12. The said unit may easily be removed from the cylinder 13 for inspection and service.

What is claimed is:

1. An external combustion two cylinder engine arrangement comprising in combustion, a separate low temperature and high temperature cylinder with a cylindrical heater head of arcuately shaped pipes arranged therebetween, and a cylindrical combustion chamber surrounded by a recuperative heat exchanger comprises a single unit mounted abutting one end of said cylindrical heater head to permit removal as a unit.

2. A heating device as claimed in claim 1, characterized in that said heater head is mounted at the bottom of an insulated cylinder which is open at one end and adapted to receive said unit.

* * * * *

UNITED STATES PATENT OFFICE

CERTIFICATE OF CORRECTION

PATENT NO. : 4,055,952

DATED : Nov. 1, 1977

INVENTOR(S) : JOHANSSON ET AL.

It is certified that error appears in the above-identified patent and that said Letters Patent are hereby corrected as shown below:

Claim 1, line 2, delete "combustion" and insert therefor --combination--.

Signed and Sealed this

*Third* Day of *July 1979*

[SEAL]

*Attest:*

*Attesting Officer*

LUTRELLE F. PARKER

*Acting Commissioner of Patents and Trademarks*